US008282486B2

(12) United States Patent
Lander

(10) Patent No.: US 8,282,486 B2
(45) Date of Patent: Oct. 9, 2012

(54) LIVE COMBAT SIMULATION

(75) Inventor: Peter John Lander, Queensland (AU)

(73) Assignee: Pathfinder Events Pty Ltd, Queensland (AU)

( * ) Notice: Subject to any disclaimer, the term of this patent is extended or adjusted under 35 U.S.C. 154(b) by 399 days.

(21) Appl. No.: 12/520,030

(22) PCT Filed: Dec. 20, 2007

(86) PCT No.: PCT/AU2007/001970

§ 371 (c)(1),
(2), (4) Date: Dec. 14, 2009

(87) PCT Pub. No.: WO2008/074082

PCT Pub. Date: Dec. 20, 2007

(65) Prior Publication Data

US 2010/0093436 A1 Apr. 15, 2010

(30) Foreign Application Priority Data

Dec. 21, 2006 (AU) ..... 2006907258

(51) Int. Cl.
*A63F 9/24* (2006.01)

(52) U.S. Cl. ..... 463/37; 463/38

(58) Field of Classification Search ..... 463/37, 463/38

See application file for complete search history.

(56) References Cited

U.S. PATENT DOCUMENTS

| | | | | |
|---|---|---|---|---|
| 3,898,747 | A | 8/1975 | Marshall | |
| 4,545,583 | A | 10/1985 | Pearman et al. | |
| 4,695,058 | A | 9/1987 | Carter, III et al. | |
| 4,772,028 | A | 9/1988 | Rockhold et al. | |
| 5,672,108 | A | 9/1997 | Lam et al. | |
| 5,785,592 | A | 7/1998 | Jacobsen | |
| 5,904,621 | A * | 5/1999 | Small et al. | 463/52 |
| 5,980,254 | A | 11/1999 | Muehle et al. | |
| 6,254,486 | B1 | 7/2001 | Mathieu et al. | |
| 6,579,097 | B1 * | 6/2003 | Sampson et al. | 434/21 |
| 7,632,187 | B1 | 12/2009 | Farley et al. | |
| 2004/0219491 | A1 * | 11/2004 | Shlomo | 434/11 |
| 2005/0153262 | A1 | 7/2005 | Kendir | |
| 2005/0186884 | A1 | 8/2005 | Evans | |

FOREIGN PATENT DOCUMENTS

| | | |
|---|---|---|
| CN | 1687687 A | 10/2005 |
| EP | 1632744 | 3/2006 |
| WO | WO 00/53996 | 9/2000 |

OTHER PUBLICATIONS

International Search Report, ISA/AU, International Application No. PCT/AU2007/001970, Date of Mailing Jan. 24, 2008, 3 pages.

* cited by examiner

*Primary Examiner* — Pierre E Elisca

(74) *Attorney, Agent, or Firm* — Seed IP Law Group PLLC

(57) ABSTRACT

An electric game apparatus ('the first apparatus') for use by a player in a live combat simulation, the apparatus including a firearm-like device, transmission means configured to transmit first and second signals, and a target receiver, the first signal being transmitted towards a target receiver of a like apparatus of another game player ('second apparatus') in response to firing said device when aimed at the target receiver of the second apparatus, the second signal being transmitted in response to the target receiver of the first apparatus being hit by a said first signal from a second apparatus to indicate the hit to that other player.

15 Claims, 6 Drawing Sheets

LIVE COMBAT SIMULATION

CROSS-REFERENCE TO RELATED APPLICATIONS

This application is a U.S. national stage application of PCT application PCT/AU2007/001970, filed Dec. 20, 2007, and claims the benefit of priority from Australian Patent Application 2006907258, filed Dec. 21, 2006.

BACKGROUND OF THE INVENTION

1. Field of the Invention

This present invention relates to live combat simulation and, more particularly, a firearm-like device and unit for use in live combat simulation games.

2. Description of the Related Art

Live combat simulation games using firearm-like devices emulating or simulating real-life firearms, such as laser tag or combat games, allow participants or players to participate in realistic combat simulations in a range of different indoor and outdoor environments without substantially endangering their own, and others', personal safety. Such games can be used for entertainment, sport, team building and morale building.

In a typical live combat simulation, players are divided into at least two teams. Each player is equipped with a firearm-like device arranged to generally simulate a firearm, such as a rifle or a machine-gun, for example. The devices when fired, such as by squeezing a trigger or pressing a button, emit a focused infra-red beam or pulse directed in the assumed trajectory of a projectile fired from the device. Each player also carries one or more sensors coupled to the device, which may be arranged about the head or on the body of the player, for example, for sensing "hits" (i.e. emitted infra-red beams) from another player.

Each player's device may be configured to fire a predetermined maximum number of times and also accept a predetermined number of hits, after either of which the device may enter a "dead" state in which the device is effectively inactive and unable to fire. The player, or a referee supervising the game, may then be able to reactivate ("re-spawn") the "dead" player's device so that the device is again able to be fired and the player can re-enter the game or participate in a further game.

One problem with existing firearm-like devices is a lack of immediate feedback provided to players. When a player hits another player using the device, typically the device of the hit player will emit a sound and/or actuate one or more light emitting diodes (LEDs) indicating to surrounding players that they have been hit and their device is, at least temporarily, disabled. Since a combat simulation game may be played in a large outdoor space, where distances between players may be up to 100 meters or more, it can be difficult for the firing player to determine if they have made a hit. This can result in a player believing that they are being regularly hit by other players, without realizing that they themselves are also effecting hits. This can detract from the player's enjoyment and experience, and/or the effectiveness of the game.

Further, while live combat simulation games using the devices described above have been found to be relatively popular, the appearance of the custom made firearm-like devices generally differs from real-life firearms. As such, the devices have often been found to detract considerably from the general realness and believability of live combat simulations and, in consequence, enjoyment and/or effectiveness as a training tool. The manufacturing costs associated with designing and producing a range of the custom made firearm-like devices arranged to accurately simulate in both handling and appearance a range of different firearms and for use in live combat simulations, however, is considered prohibitive.

BRIEF SUMMARY OF THE INVENTION

According to a first aspect of the present invention, there is provided an electric game apparatus ("the first apparatus") for use by a player in a live combat simulation, the apparatus including a firearm-like device, transmission means configured to transmit first and second signals, and a target receiver, the first signal being transmitted towards a target receiver of a like apparatus of another game player ("second apparatus") in response to firing said device when aimed at the target receiver of the second apparatus, the second signal being transmitted in response to the target receiver of the first apparatus being hit by a said first signal from a second apparatus to indicate the hit to that other player.

The apparatus according to preferred embodiments of the invention advantageously enables real-time hit-feedback in an indoor or outdoor environment when playing a live combat simulation game. For example, the first signal is able to effectively simulate the firing of the device, with the first signal when received by a like apparatus being indicative of a hit on the like apparatus by the first device. The second signal is able to be used to provide substantially instantaneous feedback if the first signal registers a hit, thereby enabling a player firing the device to be informed of whether the firing was successful. For example, the second signal may be used to provide feedback to the player that their hit has resulted in an opponent player being "hit" or "killed." Alternatively, or additionally, the second signal may be used to provide feedback to the player as to whether the device of the hit opponent player was already in an inactive or "dead" state.

Advantageously, the apparatus according to preferred embodiments of the invention is arranged to selectively simulate or emulate the characteristics of one or more real-life firearms. Preferably the transmitted first signal is in the same direction as the assumed trajectory of an assumed missile fired from the device.

Preferably, the target receiver comprises at least one sensor mountable on the body of the player using the first apparatus, the sensor being configured to sense a first signal from a second apparatus. Alternatively or additionally, the target receiver may comprise, at least one sensor provided on the firearm-like device and configured to sense a first signal transmitted from a second device.

In a preferred embodiment, the one or more sensors may be coupled to the device and arranged about and on the head or body of a player supporting the device, for example, the sensor(s) for sensing the said first signal transmitted from another player (i.e., a hit). Alternatively, the sensor(s) may be mounted on the device, whereby the receiver is formed as an integral part of the device. Alternatively, the receiver may be defined by both a part of the device and one or more sensors coupled to the device and supported on the body of the player external of the device.

Preferably, the transmission means includes an infrared transmitter for transmitting the first signal as an infra-red signal, the infrared transmitter being provided on the firearm-like device. Preferably, the firearm-like device includes a lens for focusing the infra-red signal.

In a preferred embodiment, the transmission means comprises an infrared emitter for transmitting the first signal, which may be a, preferably directional, infra-red beam or pulse, for example, Preferably, the emitter is configured to emit the first signal as a non-laser beam or pulse. A lens may be provided for focusing the infra-red beam or pulse.

Preferably, the apparatus includes adjustment means for varying an effective range of the first signal. Preferably the effective range of the infra-red beam or pulse may be selectively varied.

Preferably, the transmission means includes a radio transmitter for transmitting the second signal as a radio signal, the radio transmitter being an omnidirectional transmitter such that the radio signal is substantially omnidirectional. Advantageously, the device of the first apparatus thus need not be aimed at a second apparatus to transmit the radio signal thereto.

Preferably, the radio transmitter is a digital radio transmitter for transmitting the second signal as a digital radio signal. Preferably, the radio transmitter is provided on the firearm-like device and the firearm-like device includes a protective case housing the radio transmitter, the protective case being formed from plastic whereby the second signal may pass therethrough.

Preferably, the target receiver is configured to filter out infra-red light not associated with a first signal from a second device.

In accordance with preferred embodiments of the invention, the device may also include a visual display, such as a liquid crystal display (LCD) for providing information to a player operating the device. The information may include real-time hit feedback to the player based on the second signal, such as feedback indicating the apparatus of another player has been hit and/or that the hit player's device has switched to an inactive state in response to the first player firing their device. The displayed information may also include details of operating characteristics of one or more firearms the device may be arranged to simulate.

In accordance with preferred embodiments of the invention, the device may include a speaker for emitting or playing a sound effect in response to one or more of a signal transmit by the firearm-like device and a signal received by the firearm-like device. For example a sound effect may be played to provide real-time feedback to a player in response to one or more of the firing of the device and the device effecting a hit on another player's apparatus. Advantageously, the speaker may also be used to provide a description of one or more firearms the device is arranged to simulate. Further, the device may be arranged to selectively play sound effects in several different languages, whereby the device may be readily adapted for use in different countries.

In accordance with preferred embodiments of the invention, the device may include one or more LEDs for indicating the transmitting of the first signal. The LEDs may be used to simulate muzzle flash, for example. The device may include several differently coloured muzzle flash LEDs such that in a live combat simulation involving more than two teams of players, particularly at night, the units of opposed teams may be configured to use different coloured LEDs.

Preferably, the apparatus further comprises a receiver configured to receive a third signal for controlling its operation. The third signal may be transmitted and received during game play or before or after a game. Preferably, the receiver comprises said target receiver.

In practice, the third signal may be effected by a referee, or other supervisor, supervising a live combat simulation to efficiently and remotely control a live combat simulation, and more particularly a firearm-like device being used in the simulation.

The third signal may comprise an infrared signal, such as a directional infrared pulse or beam whereby it will be received only by an apparatus at which the signal is specifically directed. It may also or alternatively comprise a radio signal, which is substantially omnidirectional, so that it will be received by a plurality of apparatuses.

Preferably, the device is configured to switch, upon receipt of the third signal, between an active state in which the transmission means is able to transmit a first signal and an inactive state in which the transmission means is disabled from transmitting a first signal, When the transmission means is in an inactive state, the device in effect, cannot be fired.

Preferably, the apparatus comprises storage means for storing data indicative of values of operating parameters of the apparatus in accordance with the third signal.

Preferably, the apparatus is configured to store in said storage means data indicative of the number of times the target receiver has been hit by a said first signal from a second apparatus. Preferably, the apparatus is configured to store in said storage means in accordance with the third signal data indicative of a maximum number of times the target receiver is able to be hit by a first signal of a second apparatus, and the apparatus is further configured to become inoperable when the number of times becomes the maximum number of times.

Preferably, the apparatus is configured to store in said storage means data indicative of the number of times its transmission means has transmitted a first signal. Preferably, the apparatus is configured to store in said storage means in accordance with the third signal data indicative of a maximum number of times its transmission means is able to transmit a first signal, the apparatus being further configured to become inoperable when said number of times the transmission means has transmitted a first signal becomes that maximum number.

Thus, the number of such first signals that are allowed to be transmitted by the transmission means and, in effect, the number of "shots" or "rounds" that can be fired may be controlled by the third signal; accordingly, the third signal can have the effect of "re-loading" the device with a predetermined number of "shots", for example.

Preferably, the apparatus is configured to become operable on any one of a plurality of effective channels in accordance with the third signal, each channel being specific to a particular game. Advantageously, different firearm-like devices may thus effectively listen on different channels so as to facilitate the operation of two or more separate live simulations in relatively dose proximity to one another, such as on adjacent or adjoining "battlefields" in an outdoor environment, for example.

Advantageously, the firearm-like device can be selectively arranged to transmit the third signal. A referee thus, advantageously, may not require a different type of device to transmit the third signal, and may instead use a spare device. Preferably, the apparatus is operable in a game-playing mode in which it is configured to transmit and receive the first and second signals and to receive the third signals, and in a game-controlling mode in which it is configured to transmit the third signal, the apparatus being adapted to be selectively switched between the modes.

Preferably, the transmission means is configured to transmit the third signal as a radio signal, which may be substantially omnidirectional. In this way, the signal can be received by a plurality of apparatuses, such as all of the apparatuses being used in the game. Alternatively or additionally, the transmission means may be configured to transmit the third signal as an infrared signal, which may be directional so as to be receivable only by an apparatus at which the device emitting the third signal is aimed.

It will be understood, nevertheless, that the operation of the apparatus may be manually controlled without a third signal, or other form of remote control, as described above. For example, players may configure and operate their own apparatuses without a referee or supervisor, and as such the apparatuses advantageously may be fully self-operable with inputs forming part of the apparatus, and in particular the devices, such as manual controls including inputs, such as switches, dials and/or buttons, that may be disposed on the case of the device, for example. Advantageously, the operation of the game may thus be "hubless", in the sense that the game does not require a centralised controller (operated by a referee or supervisor) or have to rely on that controller remaining operational, the game instead being able to proceed purely as a result of the interaction between the apparatuses.

Preferably, the transmission means is configured to transmit a fourth signal to a source of the third signal upon receipt of the third signal by its target receiver, the fourth signal being configured to identify the first apparatus to the source, whereby the source can confirm the receipt of the third signal. Preferably, the apparatus is configured to transmit the fourth signal as a radio signal.

Preferably, the apparatus is arranged to be temporarily incapable of transmitting a first signal upon its target receiver being hit by a first signal from a second apparatus.

Preferably, the apparatus is adapted to configure the first signal such that it contains an identifier of the first apparatus, whereby a second apparatus can identify the first apparatus upon the target receiver of the second apparatus receiving the first signal, and the first apparatus is configured to identify a second apparatus according to the configuration of a first signal received by its target receiver from the second apparatus.

Preferably, the apparatus is further adapted to configure the second signal according to the configuration of the first signal received from the second apparatus by the target receiver of the first apparatus such the second signal is operably receivable only by the second apparatus.

In a preferred form of the apparatus, either the transmission means can be built into the device to form an integral part of the device, or it can be provided in a separate unit attached to a firearm having a firing action generated by an electrical triggering signal, or a simulated firearm in which operation of the trigger generates an electrical triggering signal; an example of a firearm having the required type of firing action is an airsoft electric gun (AEG).

In a preferred embodiment of the apparatus, the unit includes a (or the) protective case for housing the transmission means, the case having a bracket, such as a clamping structure, for example, for attaching the case to pre-existing structure of the firearm. Preferably, the pre-existing structure of the firearm is a standard rail or base for the mounting of a sight to which the unit can be selectively mounted and dismounted. The standard rail or base may be a pre-existing Weaver scope rail or base, for example.

In a preferred embodiment of the apparatus, the case also includes a mount to which a sight, such as a red-dot sight or telescopic scope, for example, can be clamped. Preferably, the mount forms a standard rail or base for the mounting of a sight. The standard rail or base may be a Weaver scope rail or base, for example.

In accordance with a preferred embodiment of the invention, the unit is arranged to be mounted to an existing, mass-produced, realistic-looking AEG, such as a rifle or pistol, or other toy gun having an electronic trigger switch. Advantageously, operating characteristics of the unit are able to be selected to correspond to operating characteristics of the firearm to which the unit is mounted. The unit may store details of the operating characteristics of a plurality of existing firearms, with a player able to select one of these. The operating characteristics may include one or more of effective range of the transmitted signal (range), rate at which signals may be transmitted (rate of fire) and maximum number of signals able to per transmitted (magazine capacity) (and may be set in accordance with the aforementioned third signal and/or pre-programming of the apparatus). As such, by the use of sound effects and applying operating characteristics preferably appropriate to the selected firearm, the unit may be used to effectively simulate a large selection of firearms, without the prohibitive manufacturing costs that would otherwise be incurred if a number of the previously proposed firearm-like devices for use in live combat simulation games were separately manufactured in order to effectively simulate, in both appearance and operation, a range of different real-life firearms.

A preferred form of the unit substantially has the visual appearance of an authentic night vision scope, while still containing the optoelectronics and associated firmware for the operation of the unit. Further, the speaker may be coupled to the case such that the speaker has the visual appearance of an authentic tactical torch attached to the night vision scope, for example. As such, a preferred form of the unit, when attached to a firearm, such as a small arm, for example, allows a player to feel immersed in a live combat simulation. Further, it is contemplated that a preferred form of the unit could be used, in addition to traditional skirmish-type combat simulation games, in fairs, festivals and re-enactment societies, for example. Further still, it will be understood that the designs of the unit and firearm may not be limited to a military style, and may be other designs, such as a science-fiction style, for example.

According to a second aspect of the present invention, there is provided a live combat simulation game system, the system comprising a plurality of apparatuses, each being for use by a respective game player and including a firearm-like device, transmission means configured to transmit first and second signals, and a target receiver, the first signal being transmitted towards a target receiver another of the apparatuses (a "second apparatus") in response to firing the device when aimed at the target receiver of the second apparatus, the second signal being transmitted in response to the target receiver of the apparatus being hit by a said first signal from a second apparatus to indicate a hit to the player using that second apparatus.

It will be appreciated that the aforementioned preferred features and characteristics of the apparatus according to the first aspect of the invention are equally applicable to the apparatuses in the system according to the second aspect of the invention.

In particular, the apparatuses of the system are preferably adapted to receive a third signal for controlling their operation, and the system further comprises a third apparatus adapted to transmit the third signal. Preferably, at least one of said apparatuses is configured to be operable as the third apparatus.

According to a third aspect of the present invention, there is provided a unit for use by a game player in a live combat simulation, the unit for attaching to a firearm having a firing action generated by an electrical triggering signal or to a simulated firearm in which operation of the trigger generates an electrical triggering signal the unit including a transmitter for transmitting at least a first signal towards a target receiver on another game player in response to the triggering signal, wherein the said first signal from a like device of another game player received by a target receiver of the first player is indicative of a hit on the first player by that other player.

While the unit may be only be operable to transmit the first signal, it may additionally transmit the second signal and include a receiver for the first signal (from another unit), the second (feedback) signal and possibly a third (control) signal.

In its practical application, the unit may be mounted externally to the firearm and have the effect of converting a firearm made for other purposes into a firearm for use in a live combat simulation.

The electronic system may also be installed in purpose-built plastic or metal cases which are firearm-shaped. This is especially important in the case of science fiction-type models, where commercial AEG's which are "sci-fi" in shape, and of the heavy duty metal construction as required on a commercial battlefield, may not exist.

BRIEF DESCRIPTION OF DRAWINGS

The present invention will now be described, by way of non-limiting example only, with reference to the accompanying drawings, in which.

DETAILED DESCRIPTION OF THE INVENTION

Figure 1:
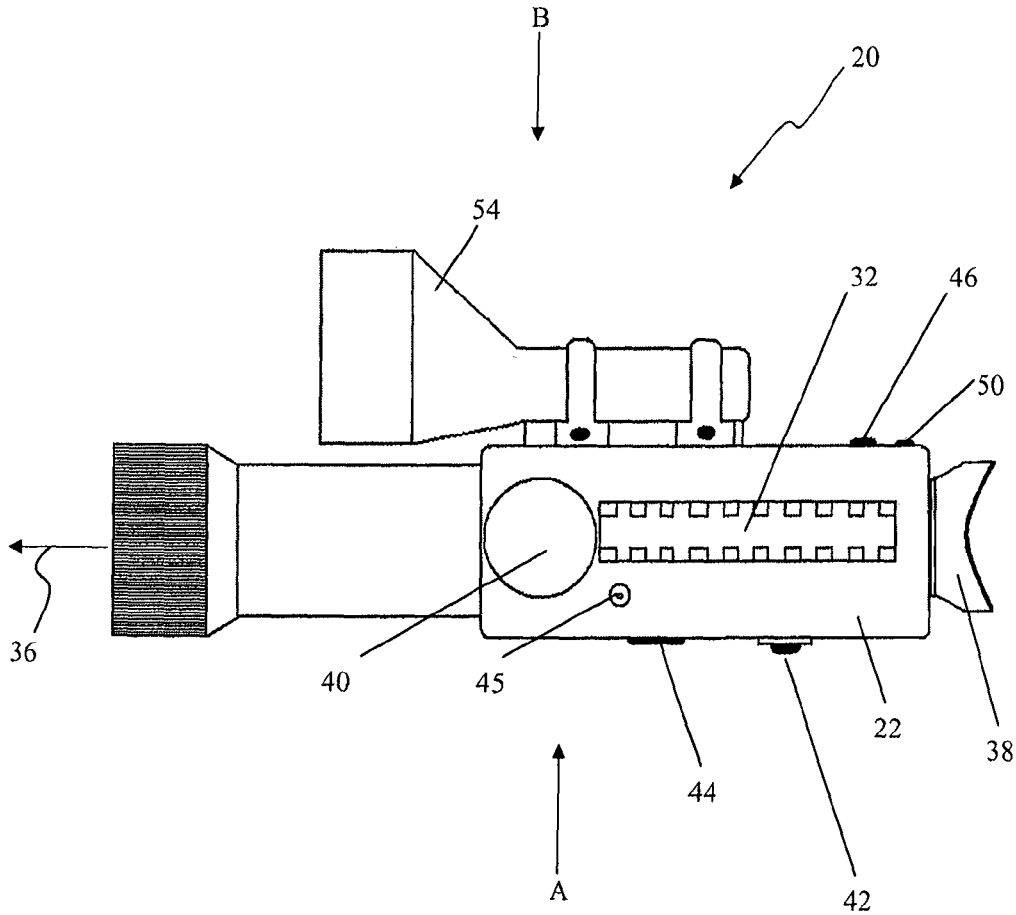
FIG. 1 is a plan view of a unit for mounting to a firearm or simulated firearm.
Figure 2:
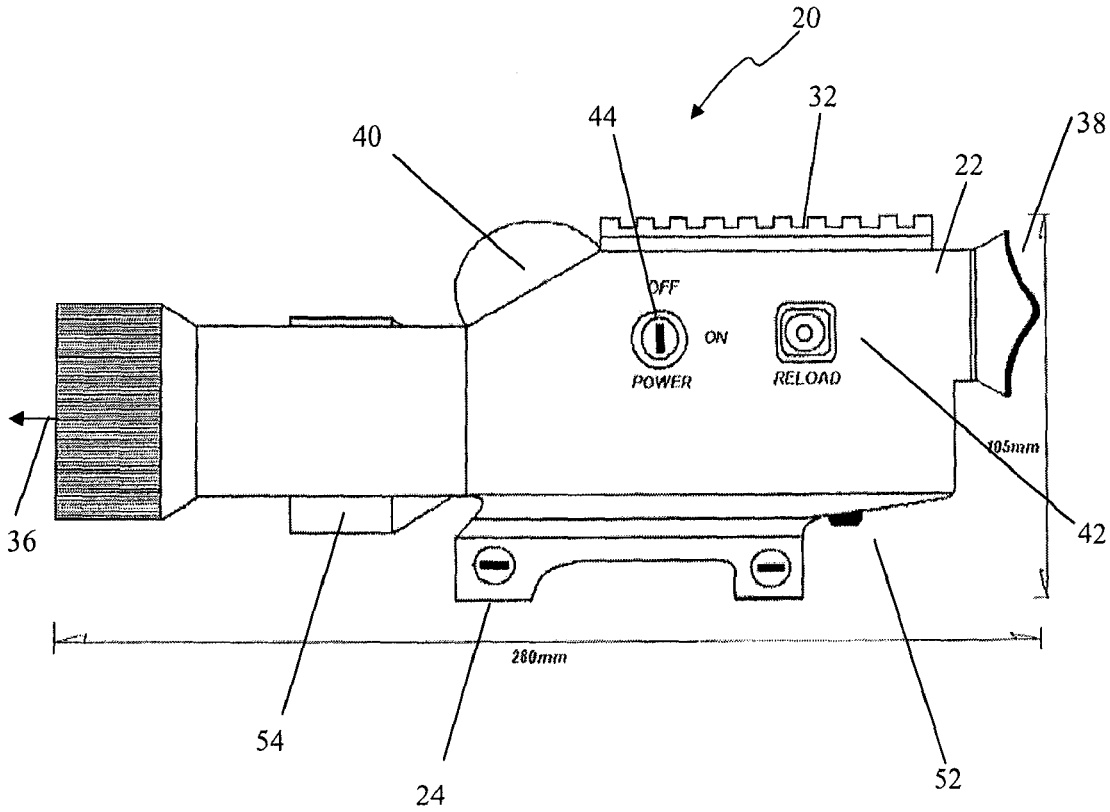
FIG. 2 is a side view of the unit shown in FIG. 1 as viewed in direction A.
Figure 3:
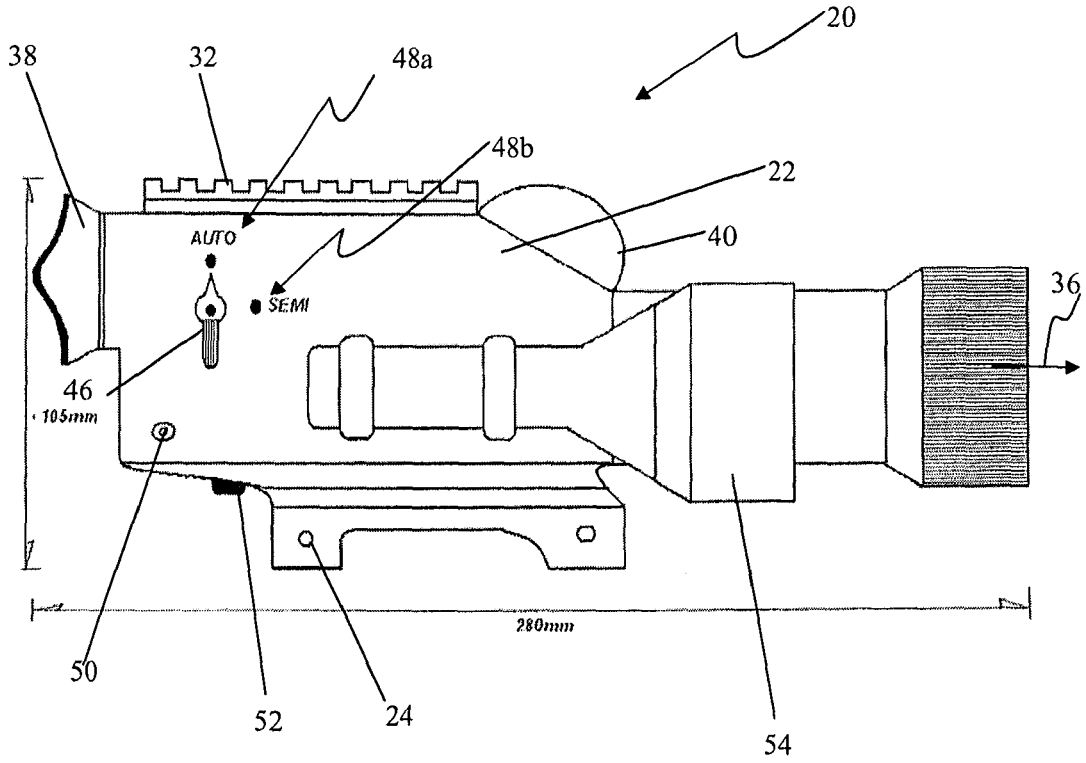
FIG. 3 is a side view of the unit shown in FIG. 1 as viewed in direction B.

The present invention will now be described with reference to the below non-limiting example of a unit for use by a game player in a live combat simulation in the form of a Small Arms Transmitter/Receiver (SATR) unit 20, which is shown in FIGS. 1 to 3. While the invention will be described with reference to the unit 20 that is arranged for mounting to a firearm having a firing action generated by an electrical triggering signal or to a simulated firearm in which operation of the trigger generates an electrical triggering signal (hereinafter referred to as a firearm), such as an AEG originally arranged to fire plastic pellets, for example, it will be understood that the present invention may alternatively be embodied in a purpose-built firearm-like device for use by a game player in a live combat simulation.

The SATR unit 20 is arranged to be attached to a firearm, the unit 20 including a transmitter for transmitting at a least first, or firing, signal and preferably a second, or feedback signal. The first signal may be in the form of an infra-red beam or pulse in response to a player in a live combat simulation game firing the firearm, such as applying pulling a trigger of the firearm, that is able to be transmitted towards a target receiver on another game player. The second signal may be in the form of a radio signal, for example, that is transmitted in response to a target receiver on a first game player being hit by the first signal from a like device of another game player, whereby the second signal indicates the hit to that other player, and, in the preferred embodiment, whether the hit has resulted in a kill, hit (wound) or the device of that other player is already in a dead state.

Accordingly, when used in the play of a live combat simulation game, an opposing player also equipped with a unit 20 may carry one or more sensors for sensing the transmitted infra-red beam or pulse, which when sensed by the sensor(s) constitutes a hit on the opposition player. Hits on a player may be used to determine functioning of the player's unit 20 and, in consequence, the player's continued participation in the game.

In the description of the example unit 20 below, it will be understood that the references to firing, ammunition, magazines and the like refer to firing of the firearm or unit 20 (the transmitting of an infra-red signal), ammunition (the number of times the unit 20 is allowed to transmit an infra-red signal), magazines (the amount of ammunition in reserve that can effectively be loaded into the unit 20) and the like as simulated by the unit 20.

Glossary of Terms Used When Describing Unit 20:

Configuration: Refers generally to the settings for the difficulty level, weapon and hit points (all defined below) on an individual unit 20, Configurations are advantageously remembered between re-boots of the unit 20.

Difficulty Level: Determines the level of difficulty for a player participating in a live combat simulation using the unit 20. During an initial boot sequence of a unit 20, each player can set the difficulty level. Three difficulty levels, for example, may include:

| Difficulty Level | Minimum Time between hits (seconds) | Automatic Reload | Default Health (hit points) | Range Reduction with Fast Firing |
|---|---|---|---|---|
| Easy | 2 | Yes | 5 | No |
| Standard | 1 | No | 5 | Yes |
| Hard | 0.5 | No | 3 | Yes |

It will be understood that the number of difficulty levels, and associated hit delays and default hit points (both defined below), may be varied as desired.

Fire Mode: Determines the mode of firing of the unit 20 (see table below) and may be selectively adjusted by a player during a live combat simulation, The fire mode is determined by a combination of the weapon (defined below), the difficulty level and the current position of a fire mode select slide. Example fire modes may include:

| Fire Mode | Description |
|---|---|
| Fully Automatic (FA) | In this mode, when the player pulls the trigger, the unit 20 fires (i.e. transmits infra-red signals) until out of ammunition or the participant releases the trigger. |
| Semi-automatic (SA) | In this mode, the unit 20 fires one round per trigger pull. However, the simulated new round is assumed to be in the chamber of the firearm automatically and very quickly, so rapid fire is still possible by the quick release and pulling of the trigger. |
| Bolt Action (BA) | In this mode, the unit 20 fires only once per trigger pull and then there is a delay and preferably a sound effect simulating a bolt |

-continued

| Fire Mode | Description |
|---|---|
| | being manually used to load a new round into the chamber of the firearm. |
| Auto Loader (AL) | In this mode, the unit 20 simulates an automatic loading pistol, such as an M1911A1/Cold.45M IV, for example. |
| Burst Fire (BF) | In this mode, the unit 20 is allowed to operate in FA mode, but is limited to simulating fully automatic bursts of up to three rounds, for example. After three rounds, the trigger must be released and then pulled again to fire further from the unit 20. |
| Revolver (RV) | In this mode, the unit 20 simulates a firearm in which the supply of ammunition is carried in a rotating cylinder. |

Gun Class: The general class of the weapon (defined below). Advantageously, the unit 20 will be configured to function in a way consistent with the firearm to which it is mounted, and further will be limited to simulating firearms consistent with the selected gun class. Example gun classes may include:

| Gun Class# | Typical Gun Case |
|---|---|
| 1 | Pistol. |
| 2 | Sub-machine gun. |
| 3 | Rifle. |
| 4 | Machine gun. |

Hit: An infra-red beam from a unit 20 that is sensed by the infra-red sensors associated with another unit 20 and causes a reduction, typically of one point, for example, in another player's "health". The number of hits that can be taken by a unit 20 before it goes into a dead state in which the unit 20 is inactive is determined by the initial hit points, which may be set at the boot of the unit 20. In a dead state the unit 20 is effectively inactive or inoperable, being unable to fire or reload ammunition, thereby preventing the player from participating in a live combat simulation.

Hit Delay: The time in seconds after experiencing a hit before a unit 20 will accept a further hit. During the hit delay, a unit 20 may effectively ignore infra-red signals, and more particularly hits, from other units 20.

Hit Points: A measure of "health"; the higher the number of hit points, the more times a player can be hit by another player before entering a dead state. Each time a player's sensors (described below) are hit by an infra-red beam, their current hit points tally (or health) is reduced by one. When the hit points reaches zero, the unit 20 enters a dead state and is disabled until re-booted or re-started (or "re-spawned" as defined below).

Magazine: The number of simulated rounds of ammunition that a unit 20 can "fire" before a re-load is required.

Range: The maximum distance a unit 20 is configured make a hit on another units sensors. A unit 20 at full power may have a range of greater than 100 meters in direct sunshine, for example. Typically, however, not all weapons will be configured for full range and the range is selectively adjusted to correspond to the weapon to which the unit 20 is mounted. Advantageously, when the unit 20 is used to simulate a shoulder-fired automatic rifles and the unit 20 is fired rapidly, for example, it will reduce the range category after a predetermined number of fired shots or duration. This simulates the inherent inaccuracy of firing fully automatic versus slower, aimed fire. Example range categories are shown in the table below:

| Range Category | % Of Maximum Range |
|---|---|
| Short | 50.00% |
| Medium | 75.00% |
| Long | 100.00% |

Re-loads: The number of times between re-spawns (defined below) of a unit 20 that a player can re-load his/her ammunition (i.e., re-load a further magazine of ammunition) to a unit 20.

Re-spawn: The process during a live simulation game of allowing or promoting players having a dead state back into the game in a "live" state by reactivating or "re-spawning" the player's unit 20 using the last configuration specified. Typically when in a dead state, a player returns to an allocated base or re-spawning area where a referee supervising the game re-starts (or re-boots) the player's unit 20 remotely or the referee or the player re-start the player's unit 20 by turning it off and on.

Rate of Fire: The number of times a unit 20 can be fired (or transmit a signal in the form of an infra-red beam or pulse) per minute. Typically the rate of fire will be selected or set to correspond to the simulated weapon or to selectively restrict the firing rates of players.

Weapon: The weapon that a unit 20 is simulating or emulating. This may be selected upon boot of the unit 20 and preferably corresponds to the firearm to which the unit 20 is mounted. Alternatively, the unit 20 may be used to simulate a firearm other than that to which it is mounted. Advantageously the unit 20 stores, or has access to, information on a plurality of real-life firearms that can be presented to a player and which the player can select the unit 20 to simulate.

For the play of a typical combat simulation game using the units 20, three physical components may be provided:

1. SATR units 20 for attachment to respective firearms.
2. Optionally, a controller in the form of a referee gun (not shown) for controlling the operation of SATR units 20 involved in the game. Alternatively, a spare SATR unit 20 may be configured to function as a referee-gun.
3. Optionally, a command module in the form of a central radio control system (not shown).

Every SATR unit can now be configured to operate at boot in one of two modes:

1. Can act like a firearm simulation system as per point 1 below
2. Can be a refereeing device using both infrared codes and radio signals to control the game.

This means there will no separate hardware required for the each device, any SATR can be picked up and deployed to handle any function.

Each of these will be discussed below.

1. SATR unit 20

The unit 20 integrates a directional infra-red emitter, infra-red sensors system, and a radio control system and is able to be mounted to a weaver rail of a firearm, such as an AEG, or suitable replica or toy gun, to allow the play of combat simulation games by simulating a real-life firearm using an infra-red system. An example SATR unit 20 is shown in FIGS. 1 to 3.

Each unit 20 includes protective outer case 22 having a bracket in the form of clamping structure 24 by which the unit 20 is advantageously able to be mounted onto a standard weaver scope rail, such as those found on many rifles, including commonly available AEGs, other toy electric guns and firearm replicas. The case 22 houses optoelectronics and preferably a radio module (described below) associated with the operation of the unit 20.

Figure 6:
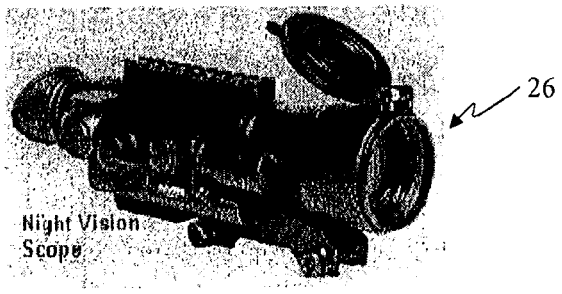
FIG. 6 is a perspective view of a previously proposed night scope.
Figure 7:
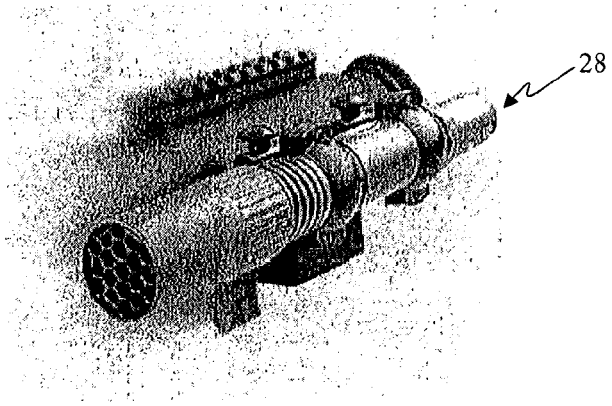
FIG. 7 is a perspective view of a previously proposed tactical torch for attachment to the night vision scope shown in FIG. 6.
Figure 8:
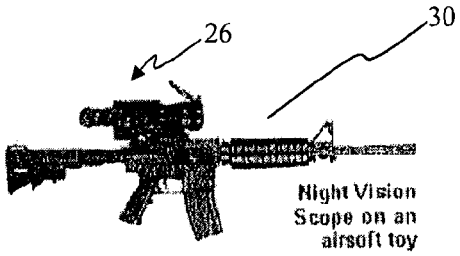
FIG. 8 is a perspective view of the night vision scope in FIG. 6 mounted to an example AEG.

Advantageously, the substantially enclosed case 22 may be formed from heavy duty injection moulded hard plastic and, as indicated in FIGS. 2 and 3, may have dimensions of around 105 mm by 280 mm and a width preferably appropriate to the firearm to which it is mounted, although it will be understood that these dimensions may be varied as desired. Preferably, the case 22 substantially looks like a typical night vision scope 26 with a tactical torch 28 attached, an example of which is shown mounted to a an example replica firearm or AEG 30 in FIGS. 6 to 8. Further, as each unit 20 will typically be required to function under often harsh conditions, the case 22 is preferably formed to be both highly water and dust resistant.

Each unit 20 includes a mount for a sight in the form of a standard weaver rail 32 to which standard sights, such as a red-dot sight, telescopic scope, or weaver scope ring mounts, for example, may be mounted. The weaver rail 32 may be integrally formed as part of the case 22 and/or formed from the same hard plastic, for example.

Each unit 20 includes circuitry (not shown), in the form of a circuit board, for example, functioning as a central processing unit (CPU) for the unit 20 and which is located within the case 22. This circuit board is advantageously also configured to generate sound effects associated with the use of the firearm and unit 20. The circuit board may be about 50 mm×70 mm, for example, with mounting points at each corner, although it will be understood the dimensions of the circuit board may be varied as required.

Each unit 20 includes software associated with the circuit board for operating the unit 20. Advantageously, the software can be configured to determine and establish settings associated with the operation of the unit on boot-up, such as by using the fire mode slide (discussed below) to enter or select settings from a menu displayed on a liquid crystal display (discussed above), for example. Preferably, one of the settings includes a selection of whether the unit 20 is operating in outdoor mode (the default operating mode) or indoor mode; in indoor mode, significantly less power may be provided to the infra-red emitter (discussed below) to reduce the range of the infrared emitter so as to reduce problems associated with infra-red bounce.

Each unit 20 includes a power source (not shown) housed within the case 22, preferably in the form of a re-chargeable battery. The battery is preferably sufficient to operate the unit 20 for at least 24 hours without requiring re-charging. The battery may be a 6 cell 7.2 volt rechargeable nickel metal hydride battery (NiMH) battery with a Tamiya connection, for example.

Each unit 20 includes an infrared emitter (not shown) housed in the casing, such as the TSAL6100, which transmits an infra-red signal in the form of a directed infra-red beam or pulse when the unit 20 is "fired" to trigger hits preferably to at least an 80-meter range in direct sunshine on a sensor (described below) of another player.

Each unit 20 includes a lens assembly, including a 50 mm glass lens having a focal length of 100 m, for example, which is located within the case 22, although it will be understood the properties of the lens may be varied as desired. The lens assembly focuses the infra-red beam when the unit 20 is fired so as to transmit infra-red light in a relatively narrow beam out of the case 22 in a generally forward direction, as indicated by the arrow 36, such that players are able to obtain hits at a range of up to about 100 meters and players have to aim to achieve hits. The lens assembly and Weaver rail 32 are advantageously in close alignment after manufacture, and remain so during use, so that the unit 20 remains zeroed under combat simulation conditions. The lens assembly may be about 30 mm longer than the focal length and about 4 mm wider than the diameter of the lens, for example, although again it will be understood that the dimensions of the lens assembly may be varied as required.

Each unit 20 includes muzzle LEDs (not shown), preferably at least one green, one white and one red, for example, located on a forward external part of the case 22. One of the LEDs will flash, under the control of the software, each time the unit 20 is fired, preferably as determined by a firmware setting. The muzzle flash may also be deactivated for simulating weapons having flash suppressors. The different colours may be used to indicate players on opposed teams, which may be advantageous for identifying players on opposing teams at night, for example.

Each unit 20 includes a liquid crystal display (LCD), for a player using the unit 20 to view, located towards the rear of the housing or, when provided inside a case instead of in an attachment, positioned on the side. The LCD (not shown) may have a black background and green text and be able to display four lines each having 16 characters, for example. A panel holding the LCD may be about 40 mm wide×8 mm depth×32 mm height, for example, although it will again be understood that these dimensions may be varied as required. The LCD may be used to display information including real-time hit feedback for indicating to a first player if another player has been hit and/or or the hit another player's device switches to an inactive state in response to the first player firing action their device. The LCD may also be arranged to display details of operating characteristics of one or more firearms the device may be arranged to simulate such as ammunition in current magazine, number of ammunition reloads available, type of weapon simulated, current weapon status (Firing, Reloading, Ready) and fire mode. Also may be shown is the current health measured in hit points. The number of hits made, kills made, accuracy percentage and number of times "re-spawned" during a game may also be displayed on the LCD in real time. The estimated expected effective range that the unit will make hits may be displayed.

Each unit 20 includes rear, preferably rubber, protective cover or eye shield 38 secured to, or formed as part of, the case 22 and located about the LCD for a player's eye to rest against while viewing the LCD and also advantageously to provide shade for the LCD in sunny conditions.

Each unit 20 includes one or more sensors 40 associate with a target receiver on the player form sensing hits (transmitted infra-red beams or pulses) from other units 20. Each sensor 40 includes an infra-red receiving circuit and preferably two coloured LEDs, such as red and green LEDs, for example. The LEDs may be activated to indicate to other players when a sensor 40 has been hit or when the unit 20, and therefore player, is in a dead or inactive state. The sensors 40 may be housed in hard plastic domes, for example, and preferably include a filtering system to minimize the impact of sunlight on the performance of the sensors. The difference in ranges between a sensor in direct sunlight compared to a sensor in darkness is preferably less than about 20%.

In one preferred arrangement, a sensor 40 is mounted on an upper, generally forward part of the case 22. Alternatively, and/or additionally, one or more sensors in the form of front and rear head sensors (not shown) that may be mounted to a hat or headband of player may be associated with the target receiver. A short electrical wire may be used to couple the front and rear sensors and a longer heavy duty cable may be used to couple preferably the rear sensor to the circuit board.

Each unit 20 includes re-load button 42 mounted on the case 22 and able to be pressed to re-load further ammunition or rounds that can be subsequently fired from the unit 20.

Each unit 20 includes on/off switch 44 mounted to the case 22, by which the unit 20 may be turned off and on. Actuation of the switch 44 may be controlled by a key lock, for example.

Each unit 20 includes on/off LED 45 mounted on the case 22, preferably near the switch, for indicating whether the unit 20 is on.

Each unit 20 includes two position slide 46 for controlling the fire mode; one position 48*a* for fully automatic (FA) fire mode and the other position 48*b* for semi-automatic (SA) fire mode, it will be understood the slide 46 may have more than two positions 48*a*, 48*b* and could be used to indicate other fire modes, for example. Moreover, the fire mode may be further limited by the selected firearm being simulated or emulated by the unit 20. Alternatively, a single button could be used to toggle fire mode.

Each unit 20 includes charging port 50 by which the rechargeable battery is able to be recharged while still inside the case.

Each unit 20 includes external power port 52 mounted on the case 22 for coupling of the unit 20 to the firearm to which unit 20 is attached. The port 52 incorporates an electric trigger input from the firearm for signalling to the unit 20 that the firearm has been fired, such as by pulling a trigger of the firearm or applying another firing-like action.

Each unit 20 includes red-dot sight, such as a 30 mm red-dot sight, or a telescopic scope, for example, mounted on the weaver rail 32. The sight or scope (not shown) may be zeroed during manufacture of the unit 20 and, in the instance of a 30 mm red-dot sight, wired so that it is powered by the main re-chargeable battery and turns off when the unit 20 is turned off. In the case of powered sights/scopes, such as red dots and particular powered telescopic scopes, the red light will flash each time the unit makes a hit or kill on another unit. This is an additional way of providing hit feedback to the firer (the other way being a sound effect), especially when the sound hit feedback system has been disabled by the user (for the purposes of stealth).

Each unit 20 includes waterproof speaker 54, preferably having a diameter of about 25 mm, for example, and located on one side of the case 22, the speaker 54 for making or playing sound effects associated with the operation of the firearm and/or unit 20, if a second speaker is required for volume requirements, the second speaker may be located on the other side of the case 22. Preferably, the speaker 54 substantially resembles a tactical torch 28 (see FIG. 7) mounted to a night vision scope 26 (see FIGS. 6 to 8).

The speaker 54 of the unit 20 is advantageously used be play sounds in response to the operation of the unit 20. For example, the speaker 54 may be used to play a commentary on the weapons the unit 20 is arranged to emulate, such as a commentary detailing characteristics of each weapon and its history. Further, the speaker 54 may be used to play sound effects corresponding to the simulated reloading of the weapon, the firing of the weapon and/or changes to the fire mode. Advantageously, the speaker 54 may also be used, when there is appropriate hit-feedback signal from another player's unit 20, to play a sound effect corresponding to the hit on the another unit 20, which preferably will be different for a hit that kills the another unit 20 (i.e. sends the another unit 20 into a dead or inactive state) and a hit that does not. Advantageously, the player may selectively turn audible feedback associated with the hit feedback-signal on and off during boot-up of the unit 20.

Each unit 20 includes radio module (not shown) that attaches to, or is integrated into, the main circuit board to provide radio receiving and transmitting capability so that the unit 20 can receive and process radio feedback signals from other SATR units, or control signals from central radio control systems (discussed below), or from any SATR unit configured to function as a referee gun (discussed below) on boot of the unit 20, for example. Advantageously the radio module is arranged to receive radio signals from up to up to at least 80 meters away, for example. Further, advantageously the preferably digital, radio module is selectively operable on several different channels, whereby different firearm-like devices may effectively listen on different channels so as to facilitate the operation of two or more separate live simulations in relatively close proximity to one another, such as on adjacent or adjoining "battlefields" in an outdoor environment, for example. In practice one channel may be used, but using a digital code, individual battles can be separated. Also note that each infra-red signal when a SATR unit is firing will also a code that isolates this SATR unit to a single battle and therefore will not trigger hits on SATR units assigned to another battle.

The hit-feedback signals advantageously may provide real-time hit-feedback to a first player's unit 20 of a hit on another player by the first player. The real-time hit feedback may be in the form of a display on the first players LCD and an audible sound effect played on the speaker 54 of the first player's unit in response to a hit-feedback signal, for example.

In practice, the control signals may be used by a referee, or other supervisor, supervising a live combat simulation to efficiently and remotely control a live combat simulation game, and more particularly units 20 being used in the game, without the need to manually key each device off and on each time to reset settings of the units 20.

Radio antenna (not shown) associated with the radio module, which comprises a wire in the sensor cable, such that the antenna is effectively externally mounted to the case, whereby existing metal cases with this technology.

Advantageously, the antenna or aerial is an omnidirectional antenna or aerial whereby the radio signal is omnidirectional (or at least multidirectional), so that the device need not be aimed at another device to transmit the radio signal to it.

2. Referee Gun Mode:

Advantageously, a SATR unit 20 may be selectively configured at boot of the unit 20 to function as a referee gun.

During play of a live combat simulation, as players are hit by other players' units 20, when a player or unit 20 is hit a predetermined number of times the unit 20 may go into a dead state in which the unit 20 is substantially inoperable. A referee gun advantageously may be provided to allow a referee, or other supervisor, supervising a game to remotely re-spawn a unit 20 that is in a dead or inactive state to a live or active state, to kill a unit 20 (i.e. remove all the unit's hit points and send the unit to a dead state) or to re-load a unit 20 with more "ammunition". For example, when a sensor of a unit 20 in the dead state is hit by an infra-red signal from a referee firearm, a re-spawn of the unit 20 into a live state may he triggered. A referee is therefore able to use the referee gun to remotely and quickly re-spawn a player with the last configuration for their unit 20 by firing the referee gun to hit the sensors of the player's unit 20. Advantageously, the referee gun is arranged to store the number of re-loads and re-spawns using the radio system.

A referee gun is a standard SATR unit configured to function as a referee gun and central radio control system.

A SATR unit configured as a referee gun has the following functions: Infrared (direct line of fire—target single unit)

Re spawn units currently dead hack to full health and full ammunition

Re load ammunition restoring all spent magazines

Pause

Resume-Kill

New Mission

Change Battle (set battle that this unit is isolated to)

Test Sensor

Shoot (deducts 1 hit point from target) Radio (affects all SATR units configured to the same battle).

Pause

Resume

End Mission (disables all SATR units in this battle)—Start Mission (enables all SATR units that were disabled)

The channel applies to both the radio system and infrared system to isolate a SATR unit to a particular battle.

When a SATR unit was previously configured as a referee gun, on boot it shows on the display:

Referee Gun

Use mode slide

To reset

To continue to operate the unit as a referee gun, the trigger is pulled. Otherwise, the mode slide is used to move through the menu options to turn the referee gun mode off.

The functions of the referee gun can be broken down into three types:

| Characters after function name | Meaning |
|---|---|
| (IR) | Signal is sent by infrared beam and only affects the SATR unit being aimed at by the referee gun. |
| (Radio) | The signal is sent by radio message and will be received and processed by all SATR units currently configured to the same battle as the referee gun. |
| Blank | These functions do not send a signal to any SATR units. They are used to change internally values such as difficulty level, hit points and battle. |

Re Spawn Mode (IR)

The default function of a referee gun is to perform re spawns on SATR units that are currently in dead state and to count the number of times this has been successfully performed during the current mission. The associated display on the referee gun is in the following form:

RESPAWN(IR)

Respawns 0

Reloads 0

Kills 0

The first line indicates the current mode the referee gun is operating in; in this case it is in "RESPAWN" mode. The "(IR)" indicates the function is performed by the infrared emitter directed by the referee towards the target SATR unit.

Other modes are accessed by using the reload button to scroll down and the mode slide to scroll up. To trigger the current function, the trigger is pulled, A re-spawn restores all the ammunition of the target SATR unit and may change the number of hit points if the referee gun is so configured. If the difficulty option has been chosen, the re-spawn process will also change the difficulty level on the target unit.

Reload Mode (IR)

This mode restores the number of magazines on the target SATR unit to the amount specified in the initial configuration of the target SATR unit. The associated display on the referee gun is in the following form:

RELOAD(IR)

Respawn 0

Reloads 0

Kills 0

On the third line of the display, it shows the number of reloads performed this mission. This is a useful feature for some missions where the amount of spare ammunition is limited.

Pause Mode (IR)

A SATR unit in live state can be paused from the referee gun using this mode. The associated display on the referee gun is in the following form:

RELOAD(IR)

Respawns 0

Reloads 0

Kills 0

Pausing prevents the player from performing any actions with the gun until it receives a resume signal in IR or radio form.

Resume Mode (IR)

This works on a SATR unit that is currently paused and resumes the target units operation. The associated display on the referee gun is in the following form:

RELOAD(IR)

Respawns 2

Reloads 1

Kills 0

Kill (IR)

The kill function is a quick way to move a target SATR unit into a dead state. This is for those times that a referee is acting in a non player role of some very destructive weapon such as artillery or automated defense system. Any SATR unit currently alive that receives the infrared kill signal instantly "dies". The associated display on the referee gun is in the following form:

KILL (IR)

Respawns 2

Reloads 2

Kills 0

New Mission (IR)

The "New Mission (IR)" function resets a target SATR unit into a live state ready for a new mission. The associated display on the referee gun is in the following form:

NEW MISSION(IR) HP4

Respawns 0

Reloads 0

Kills 0

One the first line of the display if it has a value for "HPx", then the value, of X is the health value the target SATR unit will commence live state with.

If the difficulty option is chosen, the new mission will also change the difficulty level.

The new mission function will work on any SATR unit that has passed the count down sequence including power down, ready and dead states.

Change Battle (IR)

This function allows the referee to quickly change a target SATR unit to operate in a new battle. The associated display on the referee gun is in the following form:

CHANGE BATTLE (IR) 1
Respawns 0
Reloads 0
Kills 0

Only SATR units in the same battle can hit each other or respond to radio messages.

Sensor Test (IR)

The purpose of this function is to test the target unit sensors to make sure they are receiving hits and processing the radio feedback to the initiating unit.

The head sensor on the target will flash when it receives an infrared message and the referee gun will make a short beep sound indicating that is had received a successful radio message from the target unit.

The sensor test process can occur regardless of the state of the gaming guns except if the target unit is turned off.

Shoot (IR)

In this mode, the referee gun can be shot at a target SATR unit. The target SATR unit will process the hit exactly the same as if it was hit by another SATR unit.

Pause (Radio)

All currently active units in the battle currently configured for this referee gun will pause upon receipt of this radio message. The associated display on the referee gun is in the following form:

PAUSE (Radio)
Respawns 0
Reloads 0
Kills 0

Resume (Radio)

All currently paused SATR units in the same battle as this referee gun will resume upon receipt of this signal. The associated display on the referee gun is in the following form:

RESUME(Radio)
Respawns 0
Reloads 0
Kills 0

End (Radio)

All SATR units on the same battle as the referee gun that is currently active will go to "mission over" state. Mission over state continues to display the statistics on the LCD but otherwise all functions are disabled. The associated display on the referee gun is in the following form:

END MISSION(Radio)
Respawns 0
Reloads 0
Kills 0

Start (Radio)

Any SATR units on the same battle as the referee gun currently in "mission over" state will commence 3 second count clown and the go to live mission status. The associated display on the referee gun is in the following form:

START MISSION (Radio)
Respawns 0
Reloads 0
Kills 0

Set Health

A referee gun can set the health value (hit points) of a SATR unit using re spawn or new mission functions if the health value has been previously set using the "Set Health" function.

To change the health value that the referee gun will use, the referee scrolls to the "Set Health" option. The associated display on the referee gun is in the following form:

SET HEALTH
Respawns
Reloads 0
Kills 0

The referee then pulls the trigger.

It will initially come up with the following screen if the health value has not already been set since initial boot:

Health unchanged

To change the health value, the referee uses the reload button and the mode slides to scroll down or up.

A setting of '0' health means the target SATR unit can take unlimited hits without dying.

The associated display is in the following form:

Set 4 health

Once the correct health value is displayed, the trigger is pulled to lock in the value. The SATR will then go to Respawn mode showing the health value, in this case "HP4". The associated display on the referee gun is in the following form:

RESPAWN(IR) HP4
Respawns 0
Reloads 0
Kills 0

Set Difficulty

The referee gun upon respawn or new mission (IR) function can change the difficulty level of the target SATR unit. By default no change is made to the difficulty level.

To configure the referee to change the difficulty level, the "Set Difficulty" function is used. The associated display on the referee gun is in the following form:

SET DIFFICULTY
Respawns 0
Reloads 0
Kills 0

After pulling the trigger, the list of difficulty levels is shown and it is then possible to scroll through them using the reload button or mode slide. The associated display on the referee gun is in the following form:

No Change
Easy
Standard
Hard

Set Battle

The "Set Battle" function changes what battle this referee gun will work on with its radio system and what battle a SATR unit will be changed to if the "Change Battle (IR)" function is used on it. The associated display on the referee gun is in the following form:

SET BATTLE
Repawns 0
Reloads 0
Kills 0

After the trigger pull the following menu comes up:

Battle 1
Battle 2
Battle 3
Battle 4

After selecting the battle and then pulling the trigger, mode is changed to the "Change Battle (IR)" mode.

When the referee gun effects a respawn, reload or kill on a particular SATR unit, the SATYR unit transmits a radio signal (a "fourth signal"), containing an identifier of that SATR unit, back to the referee gun which uses that signal to log a successful respawn, reload or kill on the unit and increment the count thereof maintained by the referee gun.

Boot or Start-up of a SATR Unit 20

Inputs to the unit, such as the re-load button 42, fire mode slide 46 and electric trigger input 52, for example, may all be used to set the configuration for each unit 20 on boot and by the players during a combat simulation game. During the boot sequence (or start-up) of a unit 20, a referee or the player preferably has a number of options so that the configuration of each unit 20 is able to be adapted in accordance with the skill level of the player and/or the mission being simulated. These options may include difficulty level, weapon and hit points, reloads, language of in game spoken sound effects for example. The unit 20 advantageously remembers the last configuration between re-boots (re-starts).

As discussed above, at start-up or boot-up, the SATR unit 20 may advantageously be selectively configured to function as a referee gun.

The difficulty level, which may be changed by using the re-load button on boot, for example, may be used to determine one or more of:

Hit Delay. For a harder difficulty levels the units 20 may be arranged to receive hits sooner than for an easier difficulty level, for example.

Whether the unit 20 commences an automatic re-load upon running out of ammunition. For an easier difficulty level a re-load may commence automatically while for a harder difficulty level a player may be required to use the re-load button to commence re-load, for example.

Default hit points. For an easier difficulty level the default hit points (initial health) may be set higher than for a harder difficulty level, for example.

In Game Functioning of a SATR Unit 20

Figure 4:
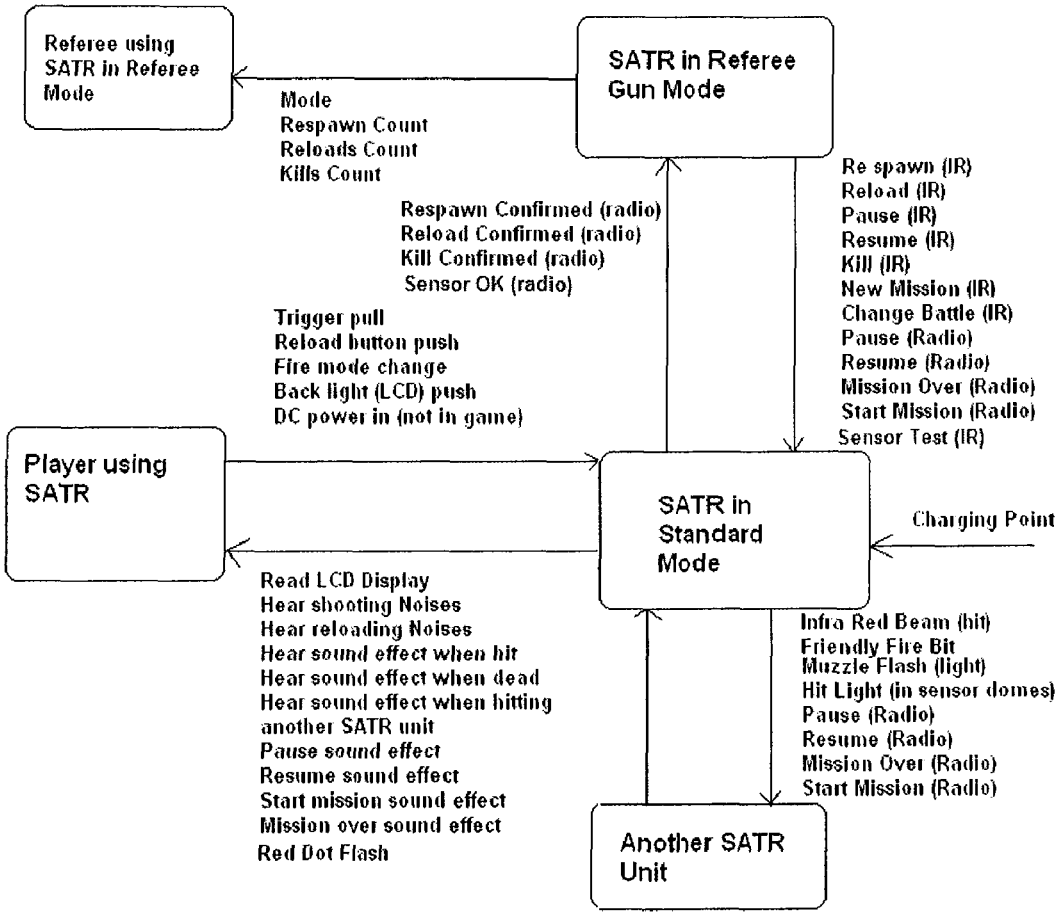
FIG. 4 is a schematic diagram showing a system including the unit of FIG. 1 for a live combat simulation.

A system for a live combat simulation, including a SATR unit 20, a player and another SATR unit 20 is schematically shown in FIG. 4, With reference to FIG. 4, during a live combat simulation, each unit 20, once booted and operational may perform the following functions 1.-5.

1. Take hits from other players' units 20 (a hit on any sensor 40 has the same effect).

Each hit (except the last one that effectively kills the unit 20 by causing it to enter a dead state) results in:

The unit 20 being disabled for the predetermined hit delay, during which time the unit 20 is unable to be fired or hit.

If the hit points after the hit is greater than three, then the LCD may display in response to a hit-feedback signal "Near Miss" on the LCD, otherwise the LCD may display "Hit".

LEDs associated with the sensors 40 flash while the unit 20 is disabled from the hit for the duration of the hit delay if specified to do so.

The hit points counter is reduced by one.

A sound effect appropriate for the remaining hit points is played.

When a unit 20 enters a dead state (hit points equal zero; i.e., the unit 20 has been hit as many times as the initial hit points), the following (dead sequence) occurs:

The LCD displays "Dead" and shows game statistics

The unit 20 enters a dead state in which it is disabled (until turned on/aft/key reset, hit by a referee gun or is re-started by the radio signal power down/power up sequence) from a SATR unit acting as a referee gun.

The LED associated with the sensors 40 stay on.

A sound effect appropriate for the unit 20 entering a dead state is played.

2. Shoot (i.e., transmit infra-red beam or pulse through unit 20 lens).

When the trigger of the firearm to which the unit 20 is attached is pulled and the unit 20 is not in a dead state, out of ammunition, re-loading or disabled for the hit delay after being hit, the unit 20 fires whereby the following occurs:

One or more directed beams or pulses of infra-red light are emitted through the lens of the unit 20.

A sound effect appropriate to the weapon and the selected fire mode is played.

The muzzle LED flashes to indicate that the weapon is firing.

3. Perform re-load sequence when re-load button is pushed.

Because there is a limited amount of ammunition per simulated magazine, players need to re-load during games. When not waiting for the hit delay after being hit and when not in a dead state, a player can attempt to re-load at any time, even if the current magazine is not empty. To re-load, the player may push the re-load button, and then wait the predetermined time for the selected weapon and other unit 20 settings to load. A sound effect appropriate to the selected weapon indicates when the re-load has started and another sound effect indicates when the unit 20 is re-loaded. Re-loading may not be instant; the re-load time may he governed by the weapon selected. If a player hits the re-load button, any ammunition in the current magazine may be lost. If the unit 20 is hit while re-loading then the re-load time starts again.

4. Allows re-spawning.

A re-spawn effectively restarts the unit 20, and may be effected by use of a key to turn the unit 20 off and on or by the unit 20 being hit by a referee gun, and allows a player to re-enter the game with full hit points and ammunition, for example. Re-spawning may be used in a game to simulate a new soldier entering a battle, for example. In referee gun mode, the unit can re-spawn unit 20 while setting the hit points to a new value.

5. Regularly updates the information displayed on the LCD.

On the square shaped LCD, the top or first line indicates health generally including remaining hit points (Health) and ammunition in the current magazine (Mag), the second line indicates the number of re-loads left (Rel), and the number of Hits (H) and number of Kills (K) and number of times re-spawned (R) and accuracy (A), the third line indicates the status and the bottom or fourth line left indicates the weapon name. For example:

Health.5/5 Mag.30/30
R.6/6 HO KO SO A0%
140 meters Ready BF
M16A2

"Health.5/5" indicates the health in hit points, "Mag.30/30" indicates the current magazine (ammunition), "R,6/6" indicates reloads. "HO KO SO A0%" indicates firing statistics. "140 metersReady" indicates range and status. "BF" indicates mode of fire. "M16A2" indicates weapon.

Values before the 7' indicate the current values and values after the 7" indicate the starting values. For example, if the unit 20 was initially set with five hit points and had been hit two times during the mission or game so far, the displayed values for the health would be "H: 3/5". The status may be varied to show any of "Dead", "Near Miss", "Hit", "Firing", "Ready" (unit 20 ready to operate), "X" (seconds to re boot) and "Re-loading".

Advantageously, the LCD of the unit may be further configured to display the number of hits and additionally hits that result in kills by a player, for example.

In Game States of a SATR Unit 20

Figure 5:
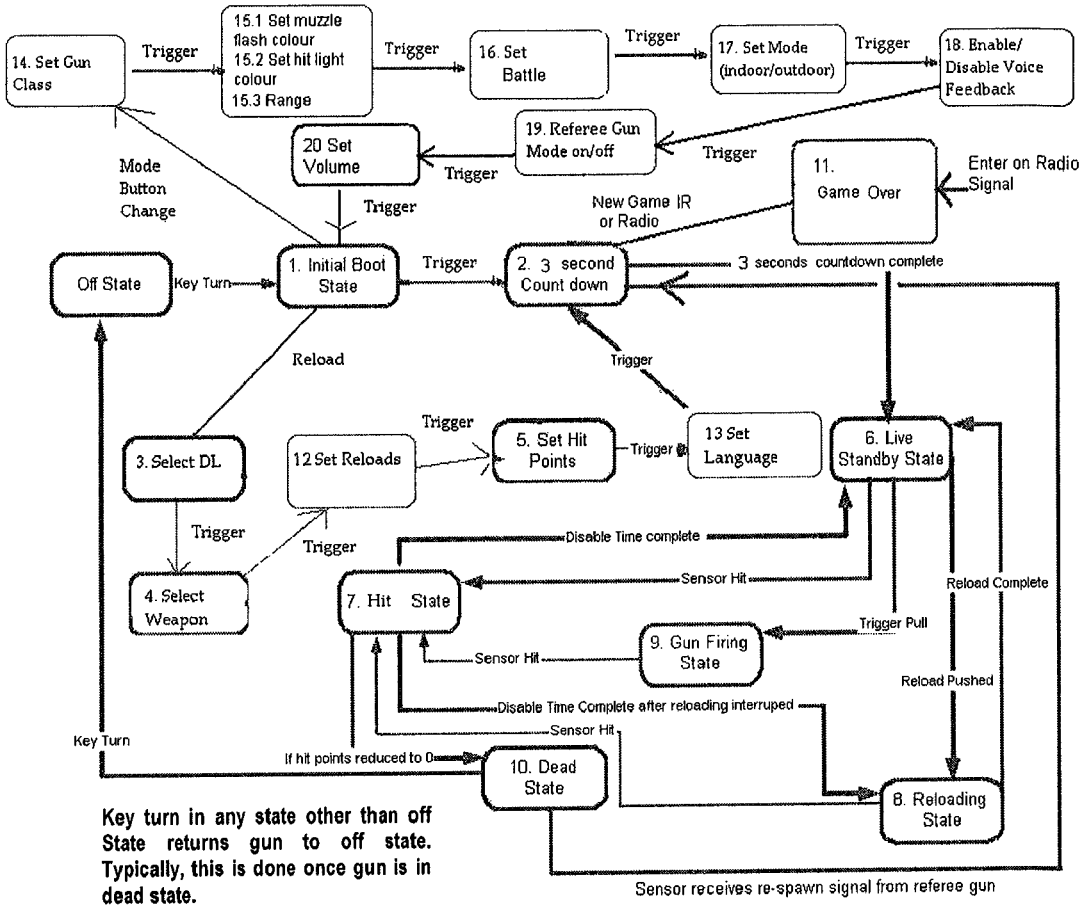
FIG. 5 is a schematic state diagram showing states of the unit of FIG. 1 when playing a live combat simulation game.

The unit 20 may be configured to go through several sates when used in a live combat simulation game. Example states the unit 20 may be configured to move through, and the transition between, each of the various states during a live simulation are shown in FIG. 5 and will be described with reference to the below pseudo-code. While it will be understood that the unit 20 will go to an off state regardless of it current state if it is turned off by the key switch 44 (complete power down), for clarity it is only shown on the state diagram as going to an off state from the dead state.

1. Initial Boot State

After the unit 20 is turned on, the unit 20 enters an initial boot state. In this state a referee, or a player, can manually select either the last configuration specified for unit 20, which the unit 20 advantageously remembers when turned off and on and re-booted, or specify a new configuration, such as by using the re-load button 42, the fire-mode slide 46 and/or the trigger of the firearm, for example.

IF the trigger of the firearm is actuated:

Start unit 20 with the last configuration the unit 20 was set to and then commence a countdown (state 2).

ELSE IF the re-load button 42 is actuated;

In order, the unit 20 will display on the LCD the following screens from which a number of configuration selections may be made. These screens may include, for example:

SCREEN 1: Easy/Standard/Hard (difficulty level; stage 3;
SCREEN 2: Weapon Name (stage 4);
SCREEN 3: Number of Reloads (stage 4.1);
SCREEN 4: Number of Hit Points (stage 5); and
SCREEN 5: Language in which audible sound effects are made or played (stage 13).

Commence countdown (state 2).

ELSE IF the fire-mode slide 46 is actuated:

In order, the unit 20 will display on the LCD the following screens from which a number of operating mode selections may be made. These screens may include, for example:

SCREEN 1: Set faun class (stage 14);
SCREEN 2: Set colour of muzzle LEDs (stage 15.1);
SCREEN 3: Set colour of hit light (stage 15.2)
SCREEN 4: Range override (stage 15.3)
SCREEN 5: Set Battle (stage 16);
SCREEN 7: Set indoor/outdoor operating mode (stage 17); and
SCREEN 8: Set enable/disable, audible feedback (stage 18).
SCREEN 9: Referee mode On/Off
SCREEN 9: Sound volume (High, Medium, Low)
SCREEN 10: Friendly fire On/Off and set team
Go back to State 1—initial boot 2. Countdown The countdown, which may be around three seconds for example, is designed to let players start or re-enter the game without being shot the instant they re-start by giving them a period in which they are able to move away from a starting or re-spawning area without being hit. During the countdown, the unit 20 cannot be fired or settings changed, although the unit 20 can enter a pause mode and also go to power-down state upon receiving an appropriate radio signal from a SATR unit acting in referee gun mode. Following the countdown, the unit 20 progresses to a live standby state (state 6).

3. Set Difficulty Level

On boot the player can select the difficulty level, such as manually by use of the reload button 42, fire mode slide 46 and trigger of the firearm.

4. Select Weapon

The player can select a weapon from the available weapons, data for which may be stored by the unit 20. Software settings may be used to determine the general gun class. The choice of weapon advantageously determines characteristics such as one or more of sound effects associated with the operation of the unit 20, rate of fire, ammunition in each magazine, available number magazines (of re-loads) and available fire modes.

As a cursor of the LCD is moved over a possible weapon selection displayed on the LCD, the unit 20 advantageously may commence playing a narrative through the speaker 54 associated with the weapon and the LCD will display the weapon name.

12. Set Reloads

Select the maximum number of reloads from 0 to 99, for example.

5. Set Hit Points

Select the initial hit points from a range of between 0 and 99. In the instance the initial hit points is set to 0, unlimited hits can be received by the unit 20. The default values for hit points are determined by the difficulty level.

Once the settings are selected (states 3 to 5), they may be locked in by pulling the trigger of the firearm, for example, at which time the unit 20 progresses to the countdown (state 2).

13. Set Language

Select the language in which audible sound effects are made or played.

6. Live Standby State

This is the state of the unit 20 in a live game. The unit 20, via an interrupt process, effectively polls input lines, giving priority to receiving hits. The LCD displays the current hit points and the rounds left in the current magazine during the live standby state.

```
IF hit signal received:
    Go to hit state (state 7).
ELSE IF re-load button 42 pushed:
    Go to re-loading State (state 8).
ELSE IF trigger pulled:
    Go to gun firing state (state 9).
ELSE IF fire mode slide 46 changes to a new position:
    Look-up fire mode table for current weapon.
    IF fire mode table allows SA and (FA or BF):
        BEGIN:
        IF fire mode slide 46 = FA:
            Make or play sound effect fo FA mode change (the sound
            effect for changing from FA to SA and from SA to FA are
            preferably different)
        ELSE:
            Make sound effect for SA mode change.
        END
    END
```

The LCD is then updated with the current values.

7. Hit State

This state is reached if the unit 20 is not currently in the dead state (state 10, hit points have been reduced to zero) and the unit 20 has taken a hit. It is effectively an interrupt process that will pause processing in other states.

```
IF (current hit points <= 1) and (starting hit points > 0):
(*The SATR unit has taken the final hit that causes it to act "dead" once the number of hit
point reaches 0*)
    BEGIN:
    Set current hit point value to 0.
    Go to dead state (state 10).
```

-continued

```
    Radio module transmits a hit-feed back signal indicating a hit, and more
    particularly a kill, has been made (hit-feedback system). END
ELSE:
    BEGIN:
    IF (starting hit points > 0):
    (*The player has been hit but has enough health to remain in the game. The
    player's health is, however, reduced by each hit. The fact the player has been hit is
    signaled to the shooting SATR unit by a radio signal.*)
        Decrement current hit points by 1.
        Radio module transmits a hit-feed back signal indicating a hit has been
        made (hit-feedback system).
    IF (current hit points < 3):
        BEGIN:
        Display "Hit" on LCD.
        Make appropriate non-fatal hit noise.
        Radio module transmits a hit-feed back signal indicating a hit, has been
        made (hit-feedback system).
        END
    Else
        BEGIN
        Display "Near Miss" on LCD.
        Make appropriate near miss noise sound effect.
        Radio module transmits a hit-feed back signal indicating a hit, and more
        particularly a near miss, has been made (hit-feedback system).
        END
    END
(*A SATR unit will only accept hits periodically, the time allowed before another hit will
be processed is determined by the difficulty level*)
IF difficulty level = 1:
    Set hit state timer to 2 seconds.
ELSE IF difficulty level = 2
    Set hit state timer to 1 second
ELSE:
    Set hit state timer to 0.5 seconds.
(*Unless configured otherwise, when a unit processes a hit, it will flash the LEDs in the
sensor domes.*)
LOOP (until time specified in hit state timer has elapsed) DO
    Flash LEDs associated with sensors 40 for duration of hit delay.
(*A player can be hit while reloading, in which case after the hit has been processed,
reloading should continue.*)
IF previous state NOT re-loading state (state 8):
    Go to live standby state (state 6).
ELSE:
    Return to re-loading state (state 8).
```

8. Re-loading State

The default number of re-loads allowed by the unit 20 preferably depends on the weapon selected. A hit interrupt during the re-loading process will delay the reloading process while the unit 20 is in the hit state (state 7).

```
IF re-loads remaining = 0:
(*No more reloads are left and this is signalled to the player by a sound effect.*)
    BEGIN:
    Make appropriate "ammunition depleted sound effect.
    END
ELSE:
    BEGIN
    (*Player has pushed the reload button and there are spare magazines.
    Therefore, the number of spare magazines is reduced by 1 and, after a certain
    amount of time, the reload process will complete and the player can fire again
    starting with a full magazine of ammunition loaded.*)
    Decrement re-loads remaining by 1.
    Display number of re-loads left on LCD.
    Set the ammunition in the current magazine to the rounds per magazine based on
    the selected weapon. Set the re-load timer to the re-load time based on the
    weapon.
    Loop (until time specified in re-load timer is completed) Do:
    Make sound effect of appropriate magazine being inserted into weapon selected:
    END
END
Go to Live Standby State (state 6)
```

9. Gun Firing State

This state may be entered from the live standby state (state 6) when a trigger of a firearm to which the unit 20 is mounted is pulled, for example.

```
FIRED_THIS_BURST = 0;
(The player has pulled the trigger and therefore is attempting to fire the unit. The rate of
fire is determined by the type of weapon and the current fire mode selected by the
operator.*)
IF ammunition in current magazine = 0:
(*If there is no ammunition currently loaded and the trigger is pulled, no round is fired
and a dry fire sound effect is made.*)
    BEGIN
    Make dry fire sound effect.
    END
ELSE:
    BEGIN
    END_FIRE = False.
    WHILE (trigger held down AND Not END_FIRE):
        BEGIN:
        IF Ammunition in current magazine <= 0:
            BEGIN:
            Make empty chamber sound effect.
            Set ammunition in current magazine = 0.
            END_FIRE:= True.
            END
        ELSE:
        (*This section controls the rate of fire and therefore it determines the time
        between each infrared pulse (shot) as well as decrements the ammunition
        in the current magazine for each shot fired.*)
            BEGIN:
            ROF_TIMER = 0 (automatic timer re-start).
            SHOT_DELAY = 60/rate of fire (seconds).
            Fire Round (procedure below).
            Decrement ammunition in current magazine by 1.
            Increment FIRED_THIS_BURST by 1.
            IF current weapon fire mode = BA:
                Delay while ROF_TIMER < (SHOT .DELAY - Time
                required for bolt returning sound effect).
                Make bolt returning sound effect.
            ELSE:
                IF current weapon fire mode = AL:
                    BEGIN:
                    Delay while ROF_TIMER < (SHOT_DELAY -
                    Time required for pistol load round into chamber
                    sound effect).
                    Make round loaded sound effect.
                    END
            ELSE:
                    Delay while ROF_TIMER < SHOT_DELAY.
            END
            IF fire mode slide 46 = SA OR weapon fire mode = AL OR
            weapon fire mode = BA OR (weapon fire mode = BF AND
            FIRED_THIS_BURST = 3):
                END_FIRE:= True.
            END
        END
    END
Go to live standby state (state 6).
PROCEDURE Fire Round:
    BEGIN
    Look up range for the current weapon:
    (*This part handles the range reduction function for weapons that are being fired
    so quickly that effective range is reduced due to the effects of recoil.*)
    IF weapon last fired within 1 second AND not a gun class not machine gun
    AND difficulty level not easy:
        Reduce range by one category.
    IF weapon range is short then:
        IR_POWER= 0.05.
    ELSE IF weapon range is medium
        IR_POWER= 0.75.
    ELSE
        IR_POWER = 1.00
(*Where operation is indoors, the power of the infrared beam is reduced.*)
    IF (indoor mode):
        IR_POWER = IR_POWER 12.
    Trigger an infra-red pulse in the lens assembly with full Infrared power *
    IR_POWER.
    (*Muzzle LED flashed and sound effect made etc. when infrared pulse is fired.*)
```

-continued

Trigger operation muzzle flash LED(s).
Look up sound effect based on selected weapon and current weapon fire mode and make sound effect.
END Upon firing, if the unit 20 subsequently, and substantially immediately, receives a hit- feedback signal from another unit 20 indicative of a hit on the target receiver associated with the another unit, advantageously the first unit 20 unit will also provide feedback to the player using the first unit indicating the nature of the hit (for example, a hit, a kill or already dead). The feed-back may be provided by way of the by appropriate sound effects played by the speaker 54 and flashing of the red dot if fitted inside the red dot scope, for example.

10. Dead State

The dead state occurs when a player in a live combat simulation game, for example, has effectively been at least temporarily eliminated from the game by being hit by other players' units 20 (i.e. the unit 20 is in an inactive state at least until re-started by the player or a referee, for example). The unit 20 can subsequently be re- spawned back into a live state, such as to the countdown state (state 2), as discussed above.

Make Dead Sound.

Display "Dead" on the display.

Turn LED(s) associated with the Sensor 40 on (not flashing).

Radio to the unit 20 that effected the hit that a kill has been effected (i.e. the hit unit 20 has gone to a dead state).

11. Power Down State

The purpose of this state is to allow all units 20 within range of the radio signal from a SATR unit working in referee gun mode to be effectively power-downed or turned off all at once. In this state, all functions of the electronics are preferably shut down, except the LCD. A powered down unit 20 listens for a power-up or "on" signal from the radio system. Upon receiving an on signal, the unit 20 reboots to the last set configuration thereby effectively commencing a re-spawn.

It will be understood that the example states discussed above and example operation of the unit 20, such as when used by players participating in a live combat simulation game, such as a infrared combat simulation game, are provided by way of non-limiting example and that the operation of the unit 20 may be selectively varied to suit requirements. As such, it will be understood that the units 20 have been described by way of example only and modifications and variations may be made without departing from the spirit and scope of the invention described.

Throughout this specification and the claims which follow, unless the context requires otherwise, the word "comprise", and variations such as "comprises" and "comprising", will be understood to imply the inclusion of a stated integer or step or group of integers or steps but not the exclusion of any other integer or step or group of integers or steps.

The reference in this specification to any prior publication (or information derived from it), or to any matter which is known, is not, and should not be taken as an acknowledgment or admission or any form of suggestion that that prior publication (or information derived from it) or known matter forms part of the common general knowledge in the field of endeavour to which this specification relates.

While various embodiments of the present invention have been described above, it should be understood that they have been presented by way of example only, and not by way of limitation. It will be apparent to a person skilled in the relevant art that various changes in form and detail can be made therein without departing from the spirit and scope of the invention. Thus, the present invention should not be limited by any of the above described exemplary embodiments.

What is claimed is:

1. An electric apparatus with which a person may be equipped for live combat simulation, the apparatus comprising:

a firearm-like device provided with an infrared emitter and being configured to be fired by the person such that a first combatant infrared shot signal is output from the device in a direction in which the device is aimed;

a target receiver configured to receive a second combatant infrared shot signal from a second firearm-like device of a second apparatus if the direction of that second combatant infrared shot signal is towards the target receiver; and a radio transmitter configured to transmit, to the second apparatus, a first combatant radio hit signal upon the target receiver receiving said second combatant infrared shot signal from the second firearm-like device of the second apparatus, the apparatus being configured to receive and process a second combatant radio hit signal emitted by a radio transmitter of the second apparatus upon a target receiver of the second apparatus receiving the first combatant infrared shot signal from the firearm-like device of the apparatus, to register that a hit has been made on another person in the simulation who is equipped with the second apparatus.

2. An apparatus according to claim 1, wherein the target receiver comprises at least one sensor mountable on the body of the person to be equipped with the apparatus.

3. An apparatus according to claim 1, wherein the target receiver comprises at least one sensor provided on the firearm-like device.

4. An apparatus according to claim 1, wherein the firearm-like device includes a lens to receive and focus infrared radiation from the infrared emitter whereby to output each first combatant infrared shot signal as a relatively narrow beam.

5. An apparatus according to claim 1, wherein the target receiver is configured to filter out infrared radiation not associated with the second combatant infrared shot signal from the second firearm-like device of the second apparatus.

6. An apparatus according to claim 1, including adjustment means for varying an effective range of the first combatant infrared shot signal.

7. An apparatus according to claim 1, wherein the radio transmitter is a digital radio transmitter whereby the first combatant radio hit signal is a digital radio signal.

8. An apparatus according to claim 1, including means for receiving a control signal, the apparatus being configured such that operation thereof is controllable by the control signal.

9. An apparatus according to claim 8, wherein the receiving means comprises the target receiver.

10. An apparatus according to claim 1, being selectively operable on one of a plurality of effective channels, each channel being specific to a particular combat simulation game.

11. An apparatus according to claim 1, configured such that the first combatant infrared shot signal output from the firearm-like device thereof contains an identifier of that apparatus, whereby the second apparatus, upon receipt of the first combatant infrared shot signal by the target receiver thereof, can identify the apparatus, the apparatus being further configured to identify the second apparatus upon receipt, by the target receiver thereof, of the second combatant infrared shot from the second apparatus.

12. An apparatus according to claim 11, being configured such that the first combatant radio hit signal transmitted by the radio transmitter thereof is receivable only by the target receiver of the second apparatus which output the second combatant infrared shot signal which gave rise to the first combatant radio hit signal.

13. An apparatus according to claim 1, being a game apparatus.

14. An apparatus according to claim 1, being configured such that the simulation is hubless.

15. A live combat simulation system comprising a plurality of electric apparatuses with each of which a respective person may be equipped, each apparatus comprising:

a firearm-like device provided with an infrared emitter and being configured to be fired by the respective person such that an infrared shot signal is output from the device in a direction in which the device is aimed;

a target receiver configured to receive an infrared shot signal from the firearm-like device of the other, or another, of the apparatuses if the direction of that signal is towards the target receiver; and a radio transmitter configured to transmit, to that other apparatus, a radio hit signal upon the target receiver so receiving the infrared shot signal from the firearm-like device of the other apparatus, each apparatus being configured to receive and process a radio hit signal emitted by the radio transmitter of the other, or another, of the apparatuses upon the target receiver of the latter apparatus receiving the infrared shot signal from the firearm-like device of the former apparatus, to register that a hit has been made on another person in the simulation who is equipped with the latter apparatus.

* * * * *